United States Patent [19]

Wörz

[11] Patent Number: 4,580,122

[45] Date of Patent: Apr. 1, 1986

[54] IGNITION COIL FOR IGNITION SYSTEMS OF INTERNAL COMBUSTION ENGINES

[75] Inventor: Paul Wörz, Schwieberdingen, Fed. Rep. of Germany

[73] Assignee: Robert Bosch GmbH, Stuttgart, Fed. Rep. of Germany

[21] Appl. No.: 616,222

[22] PCT Filed: Nov. 4, 1983

[86] PCT No.: PCT/DE83/00184

§ 371 Date: May 17, 1984

§ 102(e) Date: May 17, 1984

[87] PCT Pub. No.: WO84/02224

PCT Pub. Date: Jun. 7, 1984

[30] Foreign Application Priority Data

Nov. 26, 1982 [DE] Fed. Rep. of Germany ..... 3243806
Jan. 15, 1983 [DE] Fed. Rep. of Germany ..... 3301224

[51] Int. Cl.[4] ..... H01F 27/02; H01F 27/30

[52] U.S. Cl. ..... 336/96; 29/606; 264/272.19; 336/198; 336/205; 336/225

[58] Field of Search ..... 264/272.19; 29/602 R, 29/606; 336/96, 205, 198, 208, 225, 231, 221, 69, 70

[56] References Cited

U.S. PATENT DOCUMENTS

| | | | |
|---|---|---|---|
| 1,062,046 | 5/1913 | Smith | 336/231 X |
| 1,732,937 | 10/1929 | Jones | 336/225 X |
| 2,107,973 | 2/1938 | Bajon | 336/231 X |
| 2,153,090 | 4/1939 | Libbe | 336/231 X |
| 2,695,856 | 11/1954 | Firth | 336/96 X |
| 3,236,937 | 2/1966 | Harkness et al. | 336/96 X |
| 4,084,144 | 4/1978 | Weniger | 336/231 X |
| 4,179,796 | 12/1979 | Allen | 264/272.19 |
| 4,403,403 | 9/1983 | Hosoya et al. | 336/96 X |

FOREIGN PATENT DOCUMENTS

| | | | |
|---|---|---|---|
| 2838174 | 3/1980 | Fed. Rep. of Germany | 336/208 |
| 1119719 | 6/1956 | France | 336/208 |
| 351413 | 8/1937 | Italy | 336/208 |
| 21613 | 2/1977 | Japan | 336/96 |

*Primary Examiner*—Thomas J. Kozma
*Attorney, Agent, or Firm*—Frishauf, Holtz, Goodman & Woodward

[57] ABSTRACT

The secondary winding (15) and the coil body (14) carrying it are manufactured in a chambered realization, and the radial extension (height) of each chamber winding (29) decreases toward the higher chamber potential in accordance with the law of geometrical progression, so that the insulating distance (30, 31) between the secondary winding (15) and areas of the ignition coil that carry a lower potential increases with an increasingly higher chamber potential.

As a result, the volume and the weight of the ignition coil are reduced, while the electrical output remains the same.

14 Claims, 2 Drawing Figures

IGNITION COIL FOR IGNITION SYSTEMS OF INTERNAL COMBUSTION ENGINES

BACKGROUND

The invention relates generally to an ignition coil for ignition systems of internal combustion engines and more particularly to a coil with an insulating gap between the primary and secondary windings. In ignition coils of this kind, the insulating distance between the secondary winding carrying the high voltage and areas of the ignition coil having a lower potential is proportionate to the highest voltage between two potentials; this is known to be in the area of the high voltage output of the secondary winding.

Because the secondary winding is coaxial with the hollow-cylindrical primary winding, the insulating distance must necessarily exist over the entire length of the secondary winding, and in the vicinity of the first chamber of the secondary winding this distance is oversized, so that a larger quantity of potting resin is required, and the weight of the ignition coil is increased unnecessarily.

THE INVENTION

With the ignition coil for ignition systems of internal combustion engines according to the invention, the size and weight of the ignition coil are reduced, while its output remains the same. Briefly, the invention is to provide that the insulating distance of the individual chambers of the secondary winding be only so large as to correspond to the existing voltage between the chamber potential and the lower potential of the adjacent area of the ignition coil.

Advantageous further features of the invention are provided. With the embodiment of the ignition coil including a tapered coil winding form the application of the invention to a preferred embodiment of an ignition coil is illustrated. The embodiment of the ignition coil with a geometrically decreasing winding height provides the stepped change between two adjacent chambers that is most favorable in terms of the insulating distance. With the embodiment of the ignition coil including struts of trapezoidal cross-section, a secure position of the individual windings in the chamber and favorable resistance of the struts to bending are attained.

The area of the insertion or assembly opening, which is formed by the end face of the coil body of the primary winding and the bottom of the housing, must be absolutely tight while the ignition coil is potted—which is done without the iron core. In order to attain this tightness, it is already known to mold a sheath onto the end face of the coil body and to the housing bottom and to join these parts with an interference fit.

It is also known to dispose respective integral lids, outwardly offstanding, on the end face of the coil body and on the housing bottom, next to join both lids with a press fit and then to cut off these lids at a distance from the housing bottom. It is further known to have an inwardly pointing sheath protrude from the housing bottom, thereby spacing the iron core apart from the coil body. All of these previously known sealing means are expensive in terms of manufacturing processes.

With the further development of the ignition coil with removable lid segments, the required tightness in the vicinity of the insertion opening is attained at low engineering expense. Because the potting of the ignition coil is effected before the two lids are removed, both predetermined breaking points provide the required sealing, and only after the potting compound has cooled are both bottoms cut off and the iron core inserted.

DRAWINGS

FIG. 1 shows an axial section of an ignition coil for ignition systems of internal combustion engines; and FIG. 2 is a fragmentary and partially sectional view of the coil housing bottom after the potting of the ignition coil.

DESCRIPTION OF THE EXEMPLARY EMBODIMENT

Figure 1:
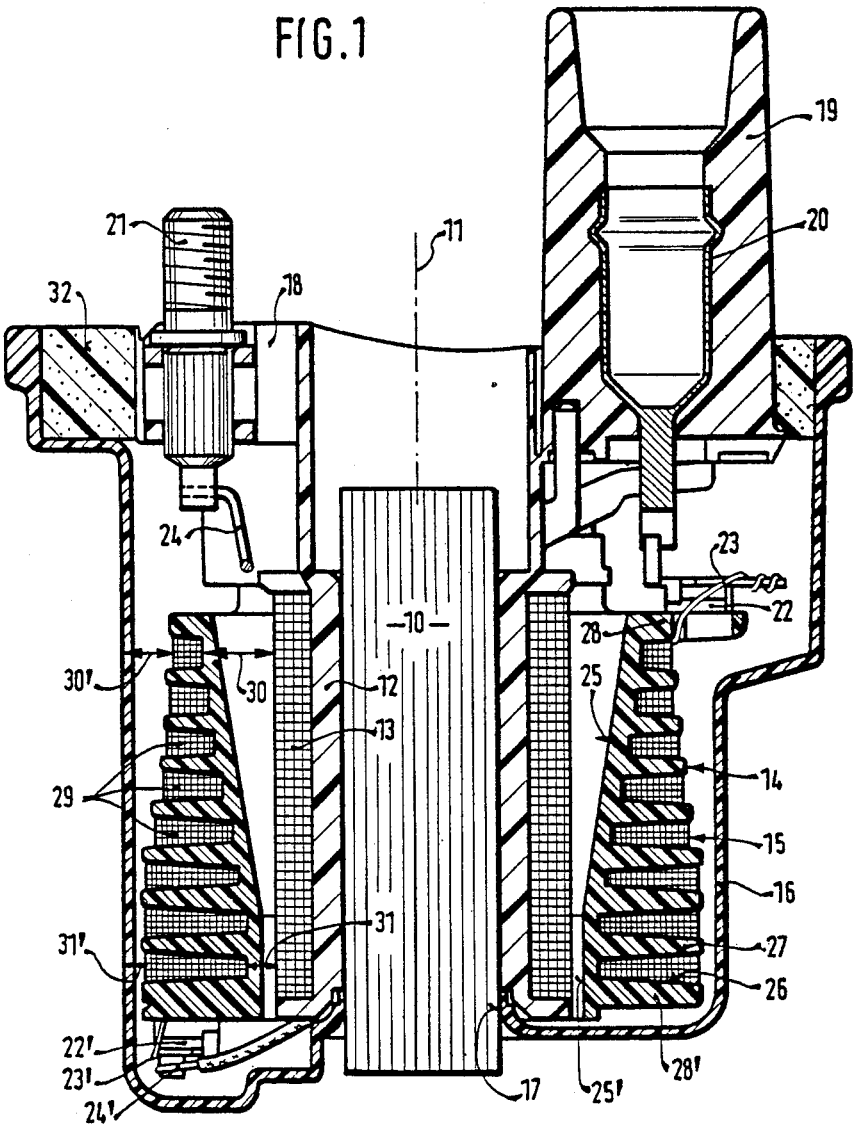

In an ignition system for internal combustion engines, FIG. 1 shows shows an ignition coil with a laminated iron core 10, which is disposed coaxially with the axis 11 of the ignition coil, and a coil body 12 coaxial with the iron core 10 and having a primary winding 13. Also coaxial therewith is a coil body 14 in chambered form and having a secondary winding 15.

A cup-shaped, substantially hollow-cylindrical housing 16 of plastic has an insertion opening 17 in its bottom for securing the coil body 12 having the primary winding 13 and the iron core 10. At its periphery 18 the coil body 12 is enlarged to form a receptacle for a dome 19 having a contact bush 20 molded inside it for the secondary connection of the ignition coil and receives two primary connection bolts 21 (only one of which is visible) for effecting a connection with the battery or ignition distributor or switching device. The first end segment 24 of the primary winding 13 makes contact with one connection bolt 21. The second end segment 24' of the primary winding and the second end segment 23' of the secondary winding 15 are fixed on a connection element 22' which makes contact with the other connection bolt, the one not shown. The first end segment 23 of the secondary winding 15 makes contact via a connection element 22 with the contact bush 20.

The coil body 14 realized in chambered form has a frustoconical inner wall segment 25 which becomes wider toward the outside, a virtually cylindrical inner wall segment 25', and forms eight annular chambers 26, for example, which are defined by seven inner annular struts 27 and two outer annular struts 28, 28'. The axial cross section of each annular strut is trapezoidal, and the narrow sides of the trapezoid form part of the outer boundary of the coil body 14. The radial extension, that is, the height, of each chamber winding 29 of the secondary winding 16 decreases in geometrical progression toward the higher chamber potential, and the individual chamber windings 29 are disposed such that the insulating distance between the secondary winding 15 and areas of the ignition coil that carry a lower potential increases with an increasingly higher chamber potential. Thus the insulating distance 30, 30', of the chamber winding having the highest chamber potential, from the primary winding 13 or from the outside of the housing 16 is greater than the insulating distance 31, 31' of the chamber winding having the smallest corresponding chamber potential. The elements of the ignition coil are secured in the housing 16 in an insulating manner by means of a potting compound 32 shown by shading in the peripheral area only.

The graduation of the chamber windings 29 in terms of their height and cross-sectional surface area does not have to correspond exclusively to a geometrical progression; it can also be accomplished taking manufacturing considerations and structural strength into account.

Figure 2:
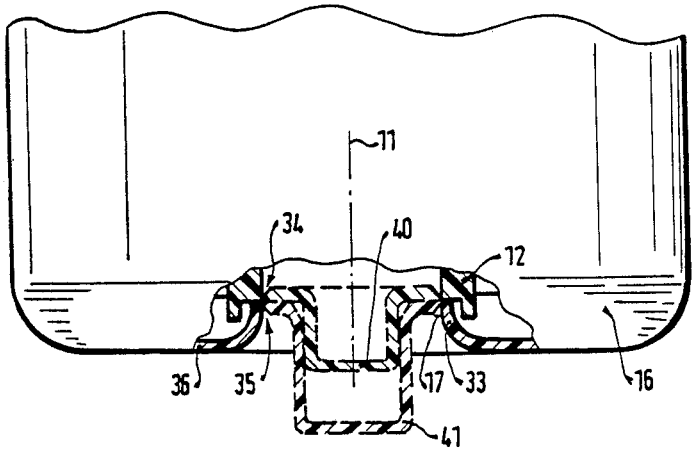

As shown in FIG. 2, the bottom 36 of the housing 16 of the ignition coil has an opening rim 33 curved inward, which is integrally adjoined via a predetermined breaking point 35 by a hat-shaped lid 41. A hat-shaped lid 40 is likewise molded to the end face of the coil body 12 via a predetermined breaking point 34; during the axial joining of the coil 12 and the housing 16, the lid 40 is inserted into the lid 41.

Subsequently the ignition coil is potted with potting compound 32, and after the compound has cooled, both lids 40, 41 are cut off by a tool at the predetermined breaking points 34, 35. Then the iron core (FIG. 1) is inserted into the insertion opening 17 in such a manner that the end segment of the iron core 10 protrudes partway past the bottom 36 of the housing 10.

The housing 16 and the coil body 12 are preferably manufactured from the thermoplastic polybutylene, reinforced with glass fibers.

I claim:

1. A reduced-weight ignition coil, for the ignition system of an internal combustion engine, having (a) a cup-shaped outer housing (16);

(b) a tapered coil winding form (14) having a plurality of radially projecting struts (27, 28, 28') defining therebetween a plurality of coil winding chambers;

(c) a primary winding (13) and a coaxial secondary winding (15), disposed at longitudinally varying insulating distances from said primary winding, one of said windings (13, 15) being wound in said chambers forming high-voltage-carrying coil portions on said tapered coil forms (14);

characterized in that (d) the insulating distance, between high-voltage-carrying coil portions of the one winding wound on said tapered coil form (14) and portions of the other of said windings which carry a lower potential, increases as the potential difference between said respective windings longitudinally increases; and (e) the insulating distance between said high-voltage-carrying coil portions and said housing (16) increases as the potential difference between said high-voltage-carrying coil portions and said housing (16) increases, and the distance between the tapered coil form and the other winding and the distance between the tapered coil form and the housing both increasing as the potential difference between said windings longitudinally increases.

2. A reduced-weight ignition coil according to claim 1 having an iron core (10) concentric with said housing (16) and a coil body (12) carrying the primary coil, characterized in that (f) said tapered coil form (14) carries the secondary winding (15) and is disposed between the primary winding (13) and a wall of the housing (16); and (g) coil windings (29) of said secondary winding (15) in respective coil winding chambers of said tapered coil form (14) have respective radial extensions or heights with respect to said iron core (10) which decrease geometrically as the voltages of the respective chamber windings increase.

3. Coil according to claim 2, in which each annular strut of the coil body separates two adjacent chamber windings of the secondary coil from one another, characterized in that the radial cross section of each annular strut (27) is trapezoidal and that the narrow side of the trapezoid partially forms the outer boundary of the coil body (14).

4. A housed coil for use in an ignitiion system of an internal combustion engine, having a cup-shaped outer housing (16) having a bottom (36) and an opening rim (33) in said housing bottom (36);

an insertion opening (17) in the housing bottom;

a sheath-like coil body (12) carrying a winding (13), an annular end face of the coil body (12) resting on the opening rim (33) of the housing bottom (36), characterized by (a) the insertion opening (17) in the bottom (36) of the housing (16) and the end face of the coil body (12) being each closed by a respective lid (41, 40) having a frangible perimeter and;

(b) potting compound (32) within said outer housing and surrounding said winding.

5. Coil according to claim 4, characterized in that the lid (40) of the coil body (12) is centered in the lid (41) of the bottom (36) of the housing (16).

6. Coil according to claim 5, characterized in that the two lids (40,41) each have the configuration of a hat and are nested one (40) inside the other (41).

7. Coil according to claim 4, characterized in that the outer rim of each lid is formed with a predetermined frangible perimeter (34,35) so that the lids (40,41) can be severed from, respectively, the end face of the coil body (12) and the opening rim (33) of the bottom (36) for insertion of an iron core (12) into said coil.

8. Coil according to claim 4, characterized in that the housing (16) and the coil body (12) comprise thermoplastic material, in particular polybutylene with glass fibers.

9. Coil according to claim 1 in which each annular strut of the coil body separates two adjacent chamber windings of the secondary coil from one another, characterized in that the radial cross section of each annular strut (27, 278) is trapezoidal and that the narrow side of the trapezoid partially forms the outer boundary of the coil body (14).

10. Coil according to claim 5, characterized in that the outer rim of each lid is formed with a predetermined frangible perimeter (34,35) so that the lids (40,41) can be severed from, respectively, the end face of the coil body (12) and the opening rim (33) of the bottom (36) for insertion of an iron core (12) into said coil.

11. Coil according to claim 6, characterized in that the outer rim of each lid is formed with a predetermined frangible perimeter (34,35) so that the lids (40,41) can be severed from, respectively, the end face of the coil body (12) and the opening rim (33) of the bottom (36) for insertion of an iron core (12) into said coil.

12. Coil according to claim 4 wherein the housing and a coil body comprise polybutylene with glass fibers.

13. Coil according to claim 7 wherein the housing and a coil body comprises a thermoplastic material.

14. Coil according to claim 7 wherein the housing (16) and a coil body comprise polybutylene.

* * * * *